US005263412A

United States Patent [19]

Chenard et al.

[11] Patent Number: 5,263,412

[45] Date of Patent: Nov. 23, 1993

[54] AIRCRAFT TRASH COMPACTOR

[75] Inventors: Berthier Chenard; Steve Van Duin, both of Bernières; Jacques Lemire, Cap Rouge; Bruno Martel, Loretteville, all of Canada

[73] Assignee: Godfrey Aerospatiale Inc., Lachine, Canada

[21] Appl. No.: 570,843

[22] Filed: Aug. 22, 1990

[51] Int. Cl.[5] ..... B30B 15/14

[52] U.S. Cl. ..... 100/229 A; 100/242; 100/255

[58] Field of Search ..... 100/229 A, 229 R, 255, 100/256, 287, 295, 52, 53, 73, 242

[56] References Cited

U.S. PATENT DOCUMENTS

| | | | |
|---|---|---|---|
| 3,687,068 | 8/1972 | Loughran | 100/255 |
| 3,748,820 | 7/1973 | Fox | 53/124 |
| 3,768,399 | 10/1973 | Martiniak | 100/229 A |
| 3,772,984 | 11/1973 | Karls et al. | 100/215 |
| 3,838,636 | 10/1974 | Engebretsen | 100/229 |
| 3,853,052 | 12/1974 | Engebretsen | 100/229 A |
| 3,859,908 | 1/1975 | Karls et al. | 100/53 |
| 3,859,911 | 1/1975 | Karls et al. | 100/215 |
| 3,861,117 | 1/1975 | DeFilippi | 53/124 B |
| 3,892,142 | 7/1975 | Karls et al. | 74/521 |
| 3,893,387 | 7/1975 | Eckerle | 100/229 A |
| 3,910,181 | 10/1975 | Andrews et al. | 100/226 |
| 3,935,812 | 2/1976 | Karls et al. | 100/214 |
| 3,945,313 | 3/1976 | Komberec et al. | 100/34 |
| 4,018,148 | 4/1977 | Wolbrink | 100/229 A |
| 4,064,798 | 12/1977 | Wolbrink et al. | 100/229 |
| 4,084,497 | 4/1978 | Kahn | 100/53 |
| 4,548,132 | 10/1985 | Moon | 100/52 |
| 4,620,479 | 11/1986 | Diamond et al. | 100/215 |
| 4,700,623 | 10/1987 | Durbin et al. | 100/52 |
| 4,719,852 | 1/1988 | Durbin et al. | 100/229 |

FOREIGN PATENT DOCUMENTS

| | | |
|---|---|---|
| 0169719 | 1/1986 | European Pat. Off. . |
| 0268709 | 6/1988 | European Pat. Off. . |
| 0322492 | 7/1989 | European Pat. Off. . |
| 2184227 | 12/1973 | France . |
| 1257438 | 12/1971 | United Kingdom . |

*Primary Examiner*—Harvey C. Hornsby
*Assistant Examiner*—Patrick F. Brinson
*Attorney, Agent, or Firm*—Foley & Lardner

[57] ABSTRACT

A trash compactor particularly designed for aircrafts and having a front compaction chamber and a rear storage chamber in communication with one another. An L-shaped support is provided in the compaction chamber for supporting a container into which trash is to be compacted. The support has a bottom member formed with a pair of grooves and the bottom wall of the compaction chamber, over which stands the support, is provided with a pair of projecting elements snugly fitting into the grooves. The latter as well as the projecting elements have a right angular wedge shape in a plane perpendicular to the upright rear wall of the support with one side of the right angle facing away from the rear wall.

13 Claims, 11 Drawing Sheets

AIRCRAFT TRASH COMPACTOR

BACKGROUND OF THE INVENTION

1. Field of the Invention

The present invention relates to trash compactors as are particularly used in passenger-carrying aircrafts or the like flying vehicles where a relatively large amount of trash accumulates during flights, rendering space-saving trash compaction essential. It resides especially in improvements in the trash compactor of Applicant's prior U.S. patent application Ser. No. 07/359,439, filed on May 31, 1989.

2. Description of the Prior Art

The trash compactor disclosed in Applicant's prior application Ser. No. 359,439 is of the type having a cabinet divided into a front compaction chamber and a rear storage chamber. The trash compaction chamber is intended to receive a container into which trash is thrown and compacted by a mechanism provided in a remote chamber above the compaction chamber. The rear storage chamber is intended to receive a trash container once it is filled. The two chambers are separated by a wall structure involving a rear wall panel which is capable of resisting the compaction pressure from the trash container but which also has to be removable in order that the filled container be moved into the storage chamber.

In one instance, in the aforesaid application, the rear wall panel is of the garage door type, that is made up of a plurality of hingedly interconnected horizontal slats made movable into a second remote chamber of the cabinet, located above the rear storage chamber. Retraction of the wall panel into the remote chamber is by means of an electric motor-operated lifting screw. The arrangement is efficient in closing and clearing the passage between the cabinet front and rear chambers but requires the use of an electric motor and related equipment making for a costly installation necessitating some maintenance.

In another embodiment, the passage between the two chambers is closed by a solid but loose back panel which is hooked onto the top edge of the back panel of the trash container before the latter is pushed into position in the compaction chamber. Once in it, the edges of this back panel rest against a solid frame which includes a vertical step or shoulder made by a drop between the bottom walls of the rear and front chambers. While the arrangement is also efficient, it is complex in construction and more particularly requires that once a container is filled, it has to be moved out of the cabinet in order to remove the solid wall panel before the container is pushed into the storage chamber.

The compactor disclosed in the above application, also comprises a movable solid wall panel which supports a side panel of the cardboard trash container to prevent it from bulging out. This wall panel is movable away from the container, once the latter is filled, by a cam-operated mechanism which is not found too convenient, particularly in that it does not ensure the wall panel to move safely in parallel relationship with itself.

Another feature of the compactor disclosed in this previous application lies in a locking mechanism for the service door which is based on the use of at least three lock bolts having to extend through the outer linings of the door frame and door opening in the front wall frame. All of these lock bolts are operated by a single linkage assembly which is, for that reason, fairly complex and not too efficient.

SUMMARY OF THE INVENTION

A main object of the invention lies in providing a trash compactor of the type disclosed hereinabove but of greater structural simplicity and easier to use in that a trash container, once filled, can be moved into the storage chamber directly and with a minimum of handling.

Another object of the invention lies in providing a trash compactor of the above type having a compaction-resistant movable wall panel that can be safely guided by simplified mechanism making use of guide pins and grooves on the panel and on the adjacent sidewall of the compactor cabinet.

Yet another object of the invention lies in providing a trash compactor wherein the service door and the refuse door can both be safely kept locked during operation of the compacting mechanism, which is not the case in the compactor of the above application.

More specifically, the invention primarily provides a trash compactor which comprises a cabinet defining a front compaction chamber and a rear storage chamber behind and in communication with the compaction chamber, the latter having opposed sidewalls, a front wall defining a door opening and a bottom wall. The compactor also includes an L-shaped support for supporting a container in the compaction chamber and into which trash is to be compacted, this L-shaped support having a horizontal bottom member and an upright rear member suitable for receiving one such trash container, and being movable between the chambers. Finally, the compactor further comprises releasable holding means on the bottom member of the support and on the bottom wall of the compaction chamber, such means being constructed to hold the support in the compaction chamber during compaction and to allow release of the support in order to displace it and move it into the storage chamber after trash compaction is completed.

In a preferred embodiment, the support bottom member is formed with at least one groove and the compaction chamber . bottom wall is provided with at least one element projecting therefrom and capable of snugly fitting into the groove, the groove and projecting element having a right angular wedge shape in a plane perpendicular to the support rear wall with one side of the right angle facing away from the support rear wall, the groove and the projecting element constituting the above-mentioned releasable holding means when the L-shaped support stands in the compaction chamber.

In another preferred embodiment of the invention, a compaction pressure-resisting rectangular wall panel is movably mounted inside the compaction chamber adjacent and parallel to one of the opposed sidewalls of the front compaction chamber, this wall panel having opposed forward and rearward vertical edges and four corners. The compactor further has lever means on the one side wall and on the forward vertical edge at an upper one of its four corners, such lever means being constructed for moving the wall panel simultaneously vertically and laterally toward and away from the above-mentioned one side wall. The compactor additionally comprises guide means on the one side wall and on the opposed edges of the movable wall panel, such guide means being constructed for ensuring movement of the wall panel in parallel relationship with the one side wall.

In still another preferred embodiment of the invention, the front wall door opening of the compactor is defined, on opposite vertical sides, by a hinge jamb and a lock jamb and the cabinet further comprises:

a service door hingedly mounted on the hinge jamb and having an inner frame including a lock riser facing the lock jamb when the service door is in closed position;

fastening means on the lock jamb and on the lock riser for locking and unlocking the service door when in closed position, the fastening means comprising:

an elongated operating bar and means, on an adjacent one of the compaction chamber walls, mounting the bar for vertical displacement thereof parallel to the lock jamb;

lock parts, on the lock jamb and on the lock riser, engageable with one another to lock the door when closed;

a downwardly biassed key on the lock riser operable, when lifted, to free the fastening means, and unlock the door;

a lever, on the bar, positioned thereon to engage the lower face of the liftable key, when the door is closed; and a handle on the bar projecting radially therefrom so as to be gripped from outside the cabinet, whereby lifting on the handle when the door is locked, causes the lever to lift the key and release the lock parts.

A preferred embodiment of the invention will now be described having reference to the appended drawings.

DESCRIPTION OF A PREFERRED EMBODIMENT

Figure 1:
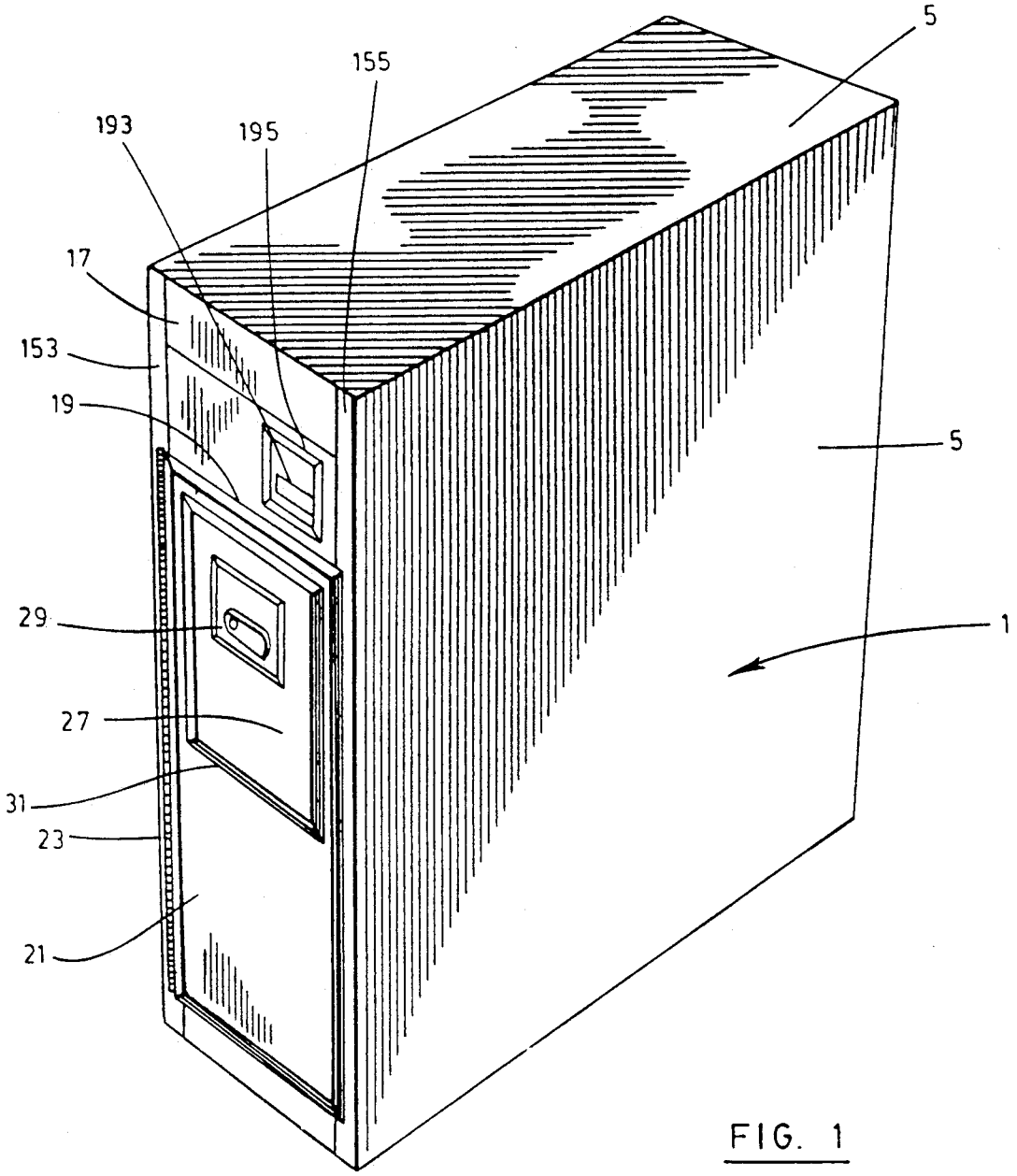
FIG. 1 is a perspective view of a trash compactor according to the invention.

Referring particularly to FIGS. 1 to 4, the improved trash compactor comprises a cabinet 1 formed of a framework 3 outwardly covered with a plating 5 and divided on the inside into a front compaction chamber 7 in communication with a rear storage chamber 9 and with remote chambers 11, 13, respectively above the compaction chamber 7 and the storage chamber 9. A compacting mechanism 15 is mounted in the remote chamber 11.

The front wall 17 of the cabinet 1 is pierced with an opening 19 across which is mounted a service door 21 by means of a hinge structure 23. The service door 21 is provided with a refuse door 27, acting as a chute for throwing trash into a container disposed in the compaction chamber 7, as is further described thereinafter. The trash door 27 has a pivotable handle 29 and a hinge structure 31 along its bottom edge, allowing it to be swung about a horizontal axis. The hinge structure 31 may be placed alternatively on either the righthand or the lefthand side of the trash door 27, permitting the trash door to swing open in a lefthand or righthand motion, as the case may be.

Figure 3:
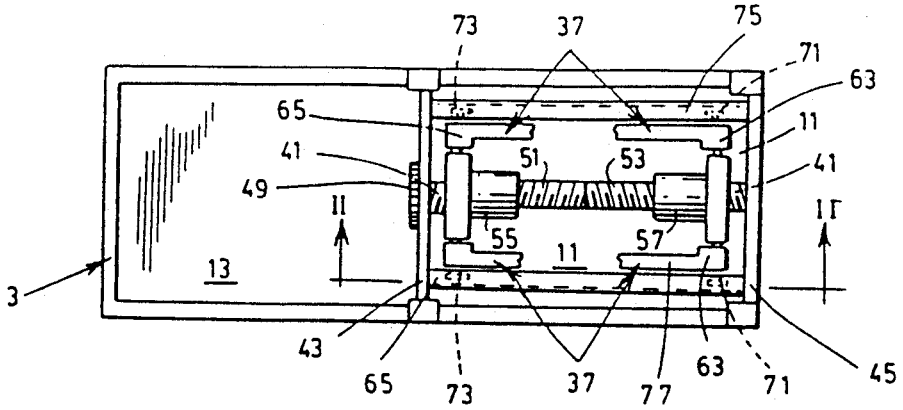
FIG. 3 is a top plan view of the mechanism shown in FIG. 2.
Figure 2:
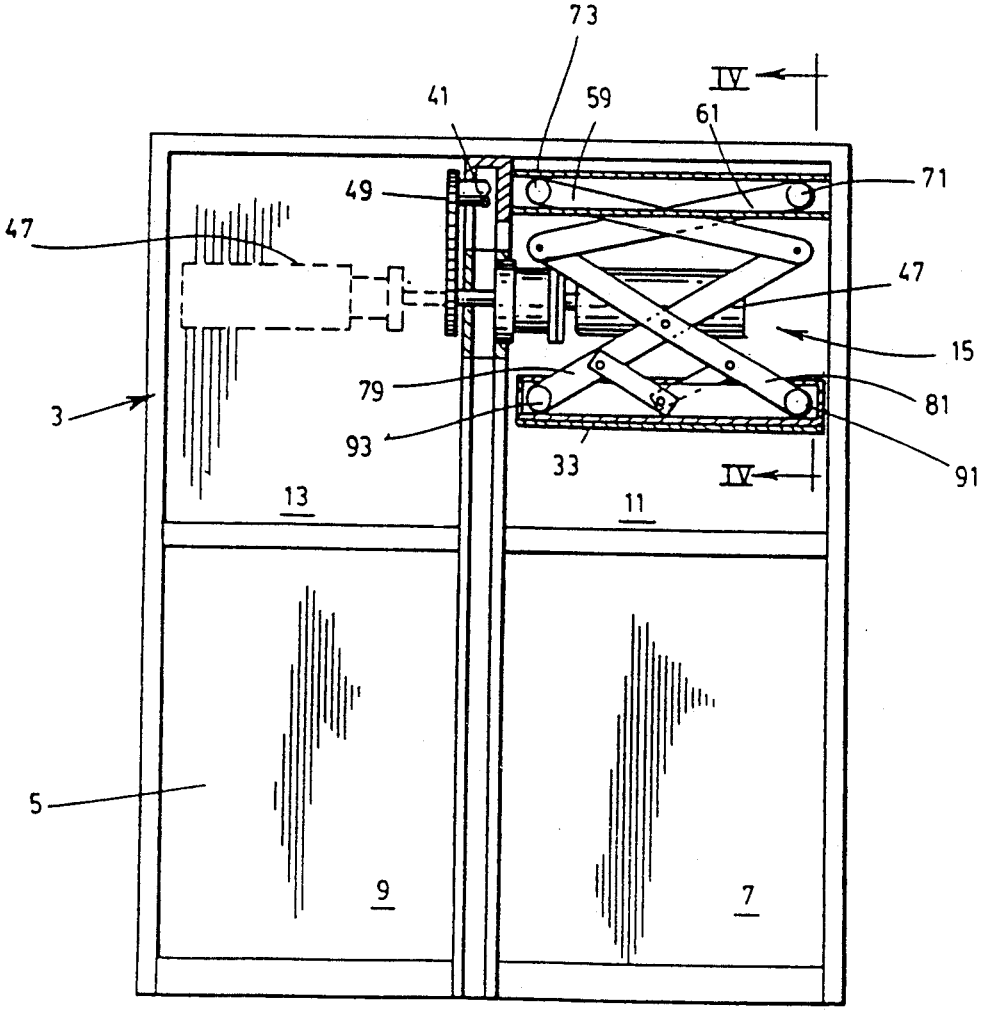
FIG. 2 is a side elevation view of the trash compacting mechanism, taken along line II—II of FIG. 3.
Figure 4:
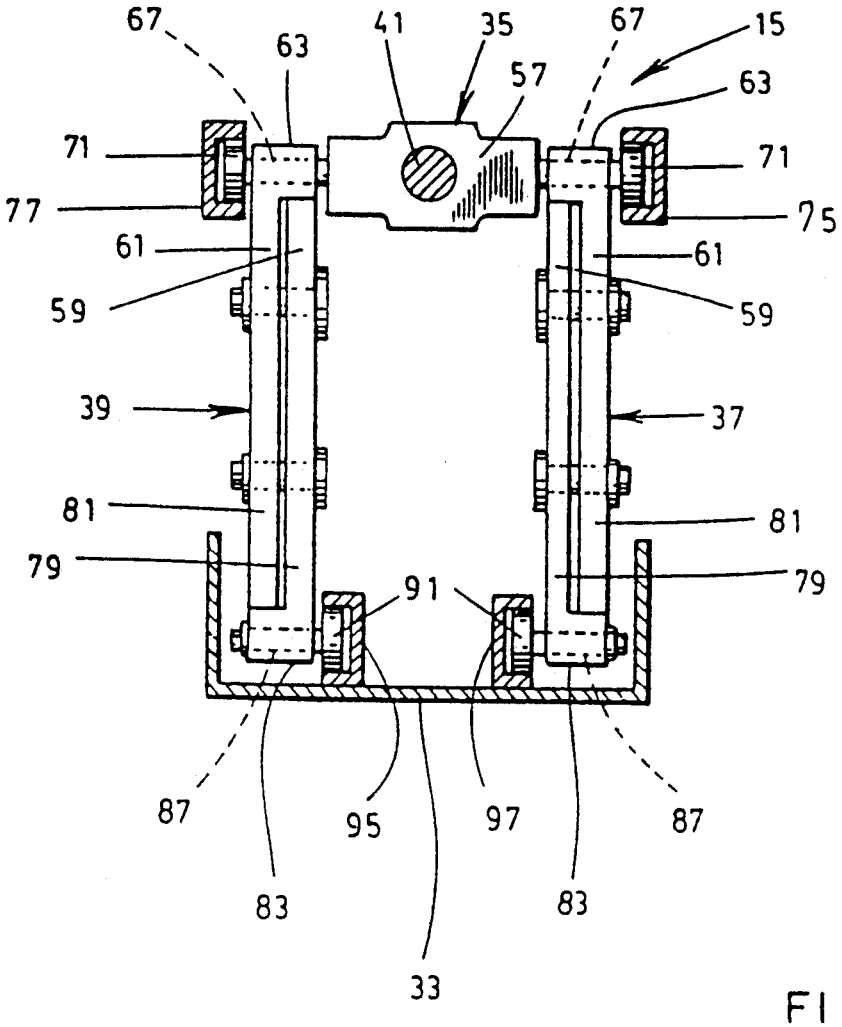
FIG. 4 is a cross-sectional view taken along line IV—IV in FIG. 2.

Referring now to FIGS. 2, 3 and 4, the compactor 15 is seen to comprise a vertically movable compaction ram 33, at its lower end; a stationary drive assembly 35, at its upper end, and two expansible and contractible pantographs 37, 39, in between; connecting the ram 33 and the drive assembly 35 to allow vertical movement of the said ram in and out of the chamber 11 to compact trash in a container held in the compaction chamber 7.

The drive assembly 35 comprises a horizontal rotary screw 41, journaled at each end in suitable bearings (not shown) on two opposing structural members 43, 45, of the cabinet framework. The screw 41 is rotated by an electric motor 47 through a chain and sprocket drive 49. Electric motor 47 may be located in either remote chambers 11 or 13, as the case may be (see the two positions shown in plain and dotted lines, respectively). Screw 41 is formed of two coaxial inverted thread sections 51, 53. Two non-rotatable driving heads 55, 57, having threaded bores, are mounted respectively on the thread sections 51, 53, so that they may move relative to one another when the screw rotates. The upper ends of the upper links 59, 61, of each pantograph 37, 39, are formed with bored legs 63, 65, turned toward the driving heads 55, 57, and through which freely extend axles (frontward axles 67 only being shown in FIG. 4) of which the inner ends are secured respectively to the heads 55, 57; upper rollers 71, 73, being mounted for free rotation on their outer ends. The rollers are received and guided into channels 75, 77, fixed to the aforesaid structural members 43, 45. In a similar manner, the lower ends of the lower links 79, 81, of each pantograph 37, 39, are formed with inwardly turned bored legs (only legs 83 being shown in FIG. 4) through which freely extend axles (axles 87 only being shown in FIG. 4) fixed to the links at one end and rotatably receiving rollers 91, 93; the latter riding in channel guides 95, 97, secured to the ram 33.

Thus, as the screw 41 is rotated by the motor 47, the driving heads 55, 57, are forced to move toward one another causing either extension or contraction of the pantographs 37, 39, depending on the sense of rotation of the screw and, consequently, rising or falling of the compaction head 33.

The above described compaction mechanism 15 is the same as that disclosed in Applicant's previous U.S. application.

Figure 5:
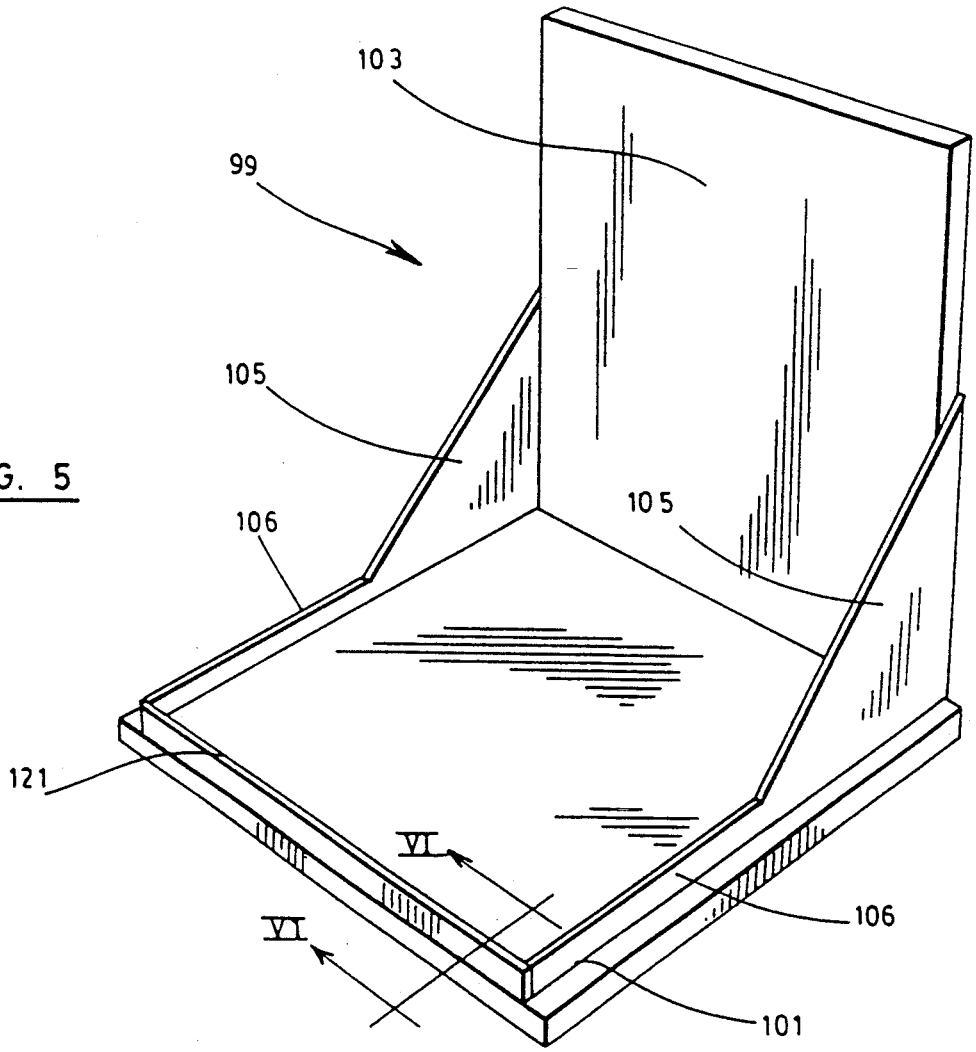
FIG. 5 is a perspective view of a L-shaped support, for a trash container, made according to the invention.
Figure 9:
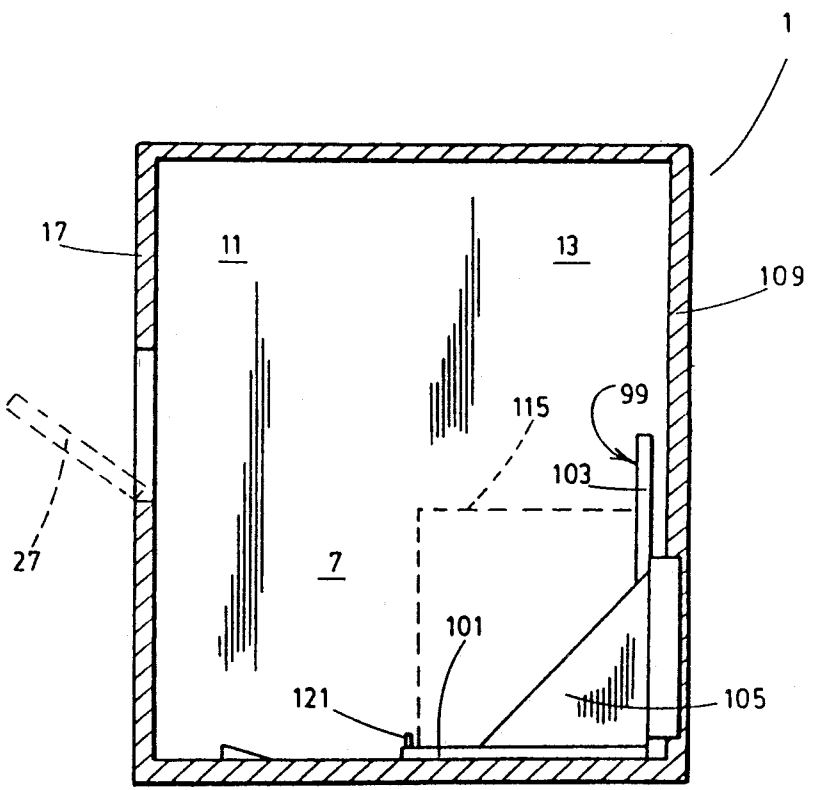
FIGS. 8 and 9 are diagrammatic longitudinal cross-sectional views of the compaction chamber showing the L-shaped container support in its compaction and storage positions, respectively.
Figure 8:
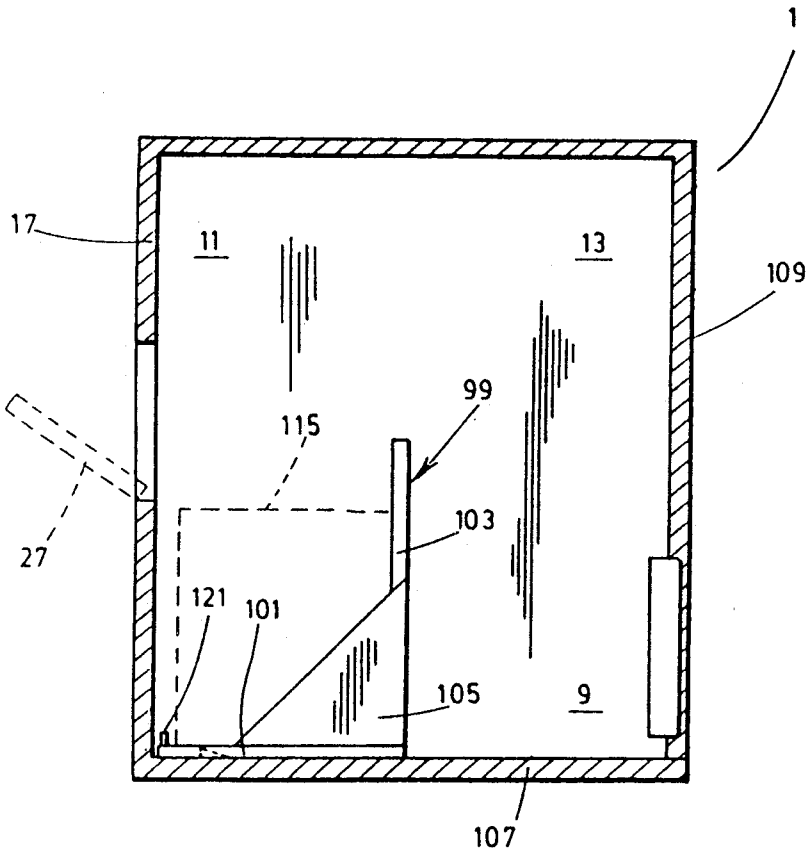
Figure 11:
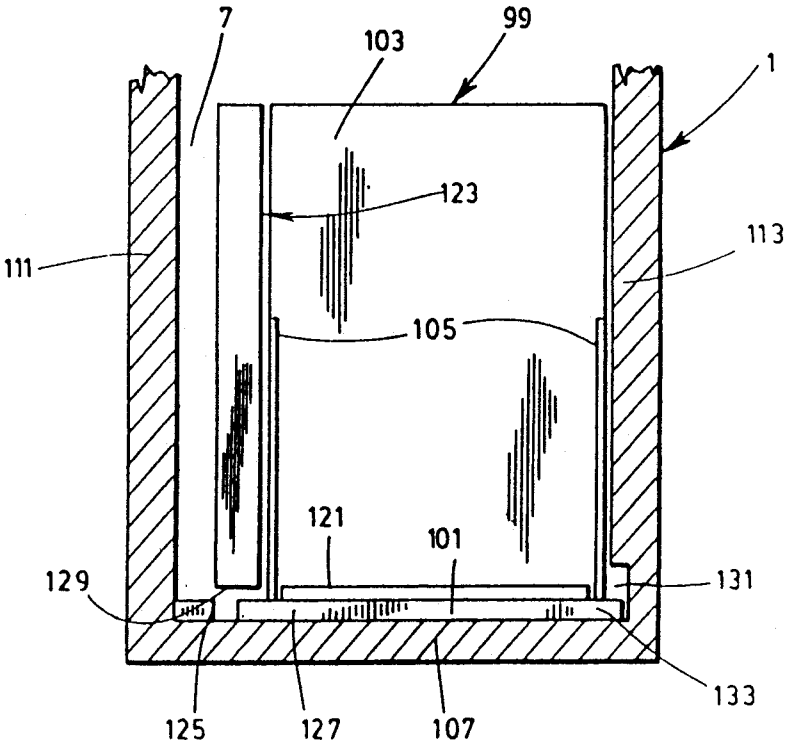
FIGS. 10 and 11 are diagrammatic transverse cross-sectional views across the compaction chamber showing the moveable wall panel in its load and move and compaction positions, respectively.
Figure 10:
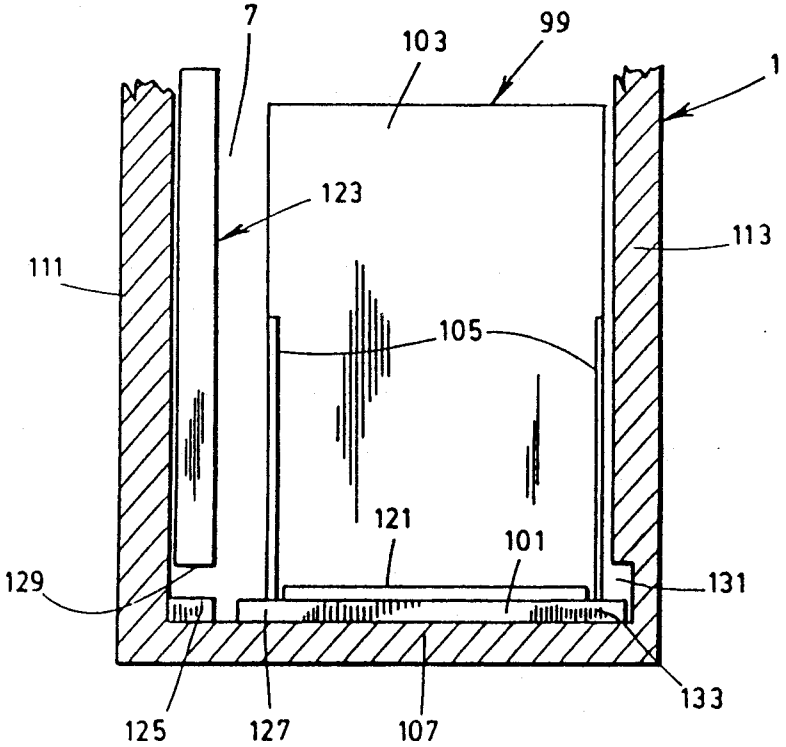

According to the present invention, there is provided an L-shaped support of suitable size for holding a container intended to receive trash to be compacted by the mechanism 15. In the embodiment shown in FIGS. 5 and 6, the L-shaped support 99 has a flat horizontal bottom member 101 and an upright rear member 103 connected to member 101 by a pair of right-angular struts 105. It is movable between the compaction and storage chambers 7, 9, as seen in FIGS. 8 and 9, being displaceable over the cabinet bottom wall 107, to and from the front wall 17 and the rear wall 109 which may be provided with an exit door, and between opposed sidewalls 111, 113 (FIGS. 10, 11). As said before, it has a size suitable to receive a trash container 115 lodged between its triangular struts 105. Triangular struts 105 may be extended by longitudinal edge plates 106, for the purpose of guiding the trash container 115 into position.

In order to prevent untimely displacement of the support 99 during compaction in chamber 7, means are provided on the bottom wall 107 of the chamber 7 and on the bottom member 101 of the support itself; such means being constructed to hold the support in chamber 7 during compaction and to allow it to be easily released so that it can be moved into the storage chamber 9, after compaction.

Figure 6:
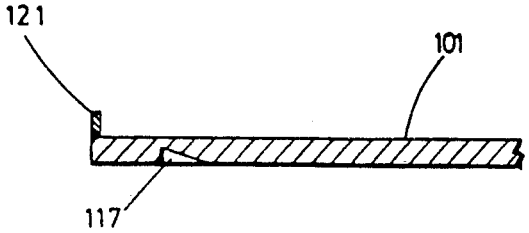
FIG. 6 is a cross-sectional view taken along line VI—VI of FIG. 5.
Figure 7:
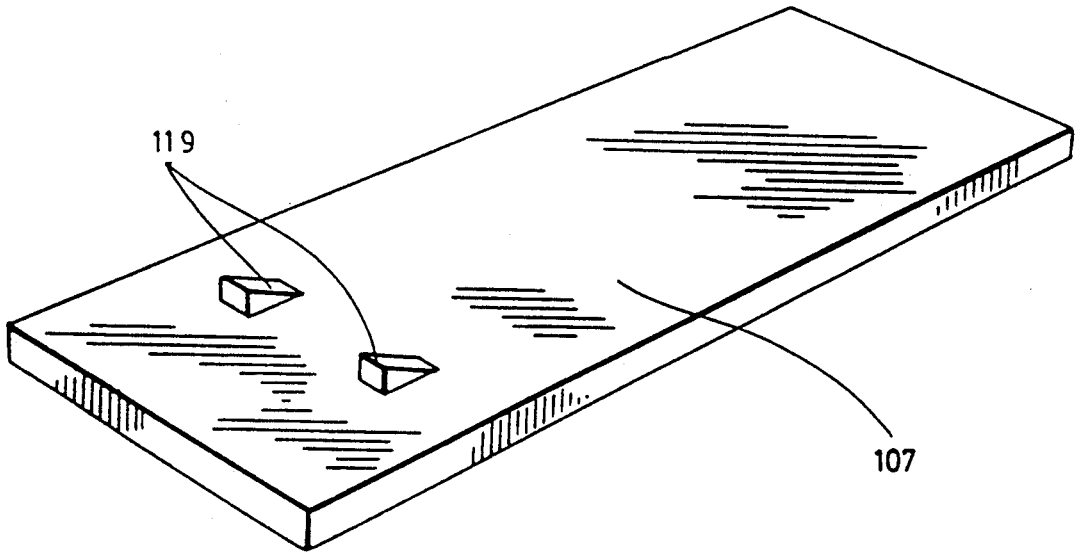
FIG. 7 is a perspective view of the bottom wall of the compactor.

The preferred means, as shown in FIGS. 6 and 7, consist in having a right angular groove or a pair of angular grooves 117 formed in the bottom member 101 of the L-shaped support 99 into which are to be received a wedge-shaped element or wedge-shaped elements 119 projecting from the top surface of the cabinet bottom wall 107, as illustrated in FIG. 7. The groove or grooves 117 and wedge or wedges 119 both have the same or similar right-angular shape in planes extending perpendicular to the support rear wall 103 with one side of the right angle facing away from the support rear wall 103. They are also sized and disposed so that the wedge or wedges 119 fit snugly into the groove or grooves 117 when the L-shaped support 99 is in the compaction chamber 7. In this manner, the L-shaped support 99 is able to resist any jolting force tending to shift it untimely from the compaction chamber 7 toward the rear storage chamber 9. Yet, the support can easily be released simply by lifting it slightly so as to free the wedges from the grooves.

As will be appreciated, various alternatives to the specific releasable holding means described above can easily be imagined by the man of the art. Thus, the grooves 117 and projecting elements 119 may be bulbous or of other triangular forms in cross-section. The wedges 119 may inversely be provided on the bottom face of the support bottom member 101 while the grooves may be formed on the bottom wall 107 of the cabinet 1. Yet, the grooves may be cut into the bottom member 101 of the support and may lodge a gravity catch, pivotable at one end and of which the other end may engage with a blunt face of a recess formed in the bottom wall 107 when the support 99 stands in the compaction chamber 7.

To facilitate release of the support 99 from the cabinet bottom wall 107, an elongated strip 121 may be provided along the forward edge of the support bottom member 101, to be finger-gripped when it is desired to tilt the support upwardly for release. The strip will also serve to prevent sliding of the trash container 115 on the bottom member 101. It may also be replaced by a finger-gripping knob or slot.

Referring now to FIGS. 10 and 11, the cabinet is seen to be provided with a compaction pressure-resisting rectangular wall panel 123 mounted inside the compaction chamber 7, adjacent and parallel to the cabinet sidewall 111, to be moved and guided simultaneously vertically and laterally toward and away from the sidewall 111, by means hereinafter fully described.

In the "away" position of FIG. 11, and as is known, the wall panel 123 bears against the adjacent side panel of the trash container and serves to prevent it from bulging out and becoming jammed in the compaction chamber. The remaining lateral or side panels of the container are, during trash compaction, refrained from unduly bulging out by the other cabinet sidewall 113, by the support rear wall 103 and by the service door 21. As seen in FIGS. 10 and 11, the L-shaped support 99 is guided, along the leftward edge, by a guiding strip 125 solid with the cabinet bottom wall 107. It is also to be noted that the bottom member 101 of the L-shaped support 99 has a first lateral extension 127 that becomes lodged beneath the horizontal lower edge 129 of the wall panel 123 when the latter is away from the cabinet sidewall 111, as in FIG. 11. The vertical distance between this extension 127 and the lower edge 129 is determined to prevent undue release of the wedges 119 from their restraining grooves 117 (FIGS. 6 and 7). Also to be noted is that the other cabinet sidewall 113 is formed, along its lower edge adjacent the cabinet bottom wall 107, with a rabbet 131 suitable to receive a second lateral extension 133 of the L-shaped support 99. The height of the rabbet must be sufficient to allow disengagement of the wedges 119 from the grooves 117 when the wall panel 123 stands close to the sidewall 111 so that the L-shaped support 99 may be pushed, with its packed trash container, into the storage chamber 9.

Figure 14:
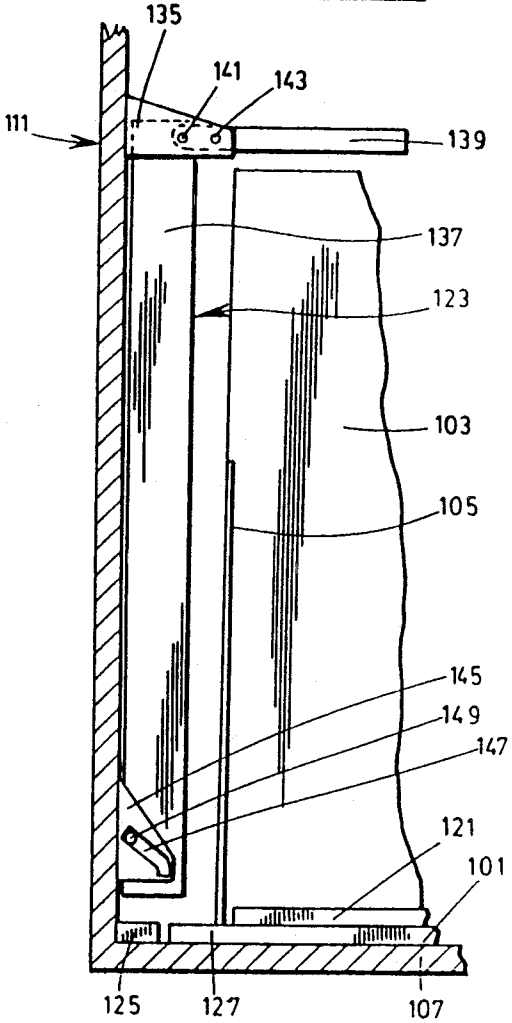
FIGS. 12, 13 and 14 are diagrammatic transverse cross-sectional views similar to FIGS. 10 and 11 but showing the moveable wall panel and moving mechanism thereof in greater details and in three successive positions.
Figure 13:
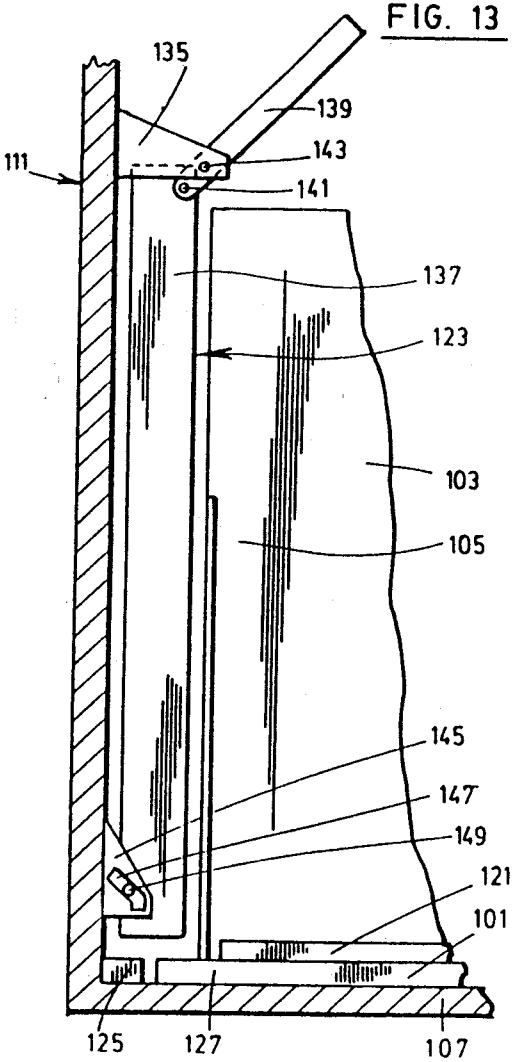
Figure 12:
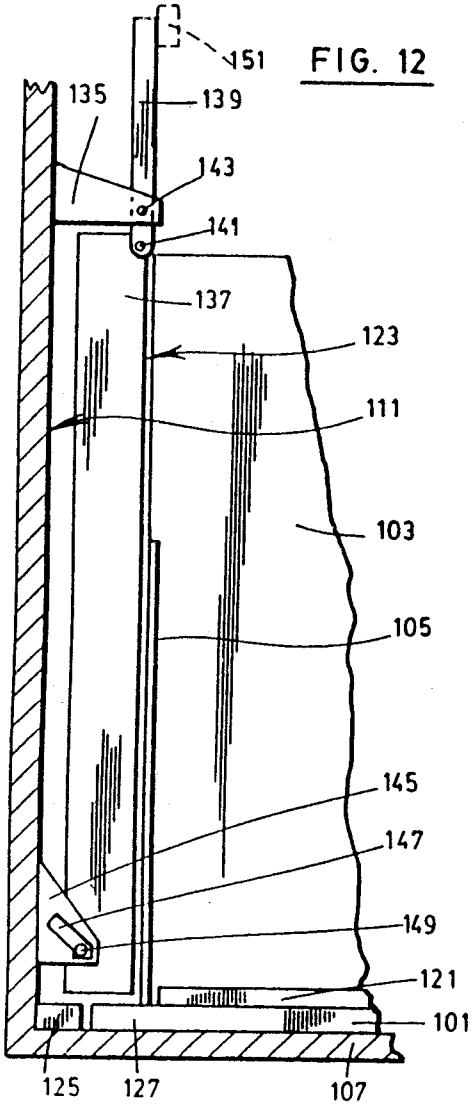

The means, mentioned above, responsible for moving and guiding the wall panel 123 simultaneously vertically and laterally toward and away from the sidewall 111, are shown in FIGS. 12, 13 and 14.

There is first a lever arrangement which involves two bracket plates 135, projecting from the cabinet or compaction chamber sidewall 111 in the direction of the wall panel 123, facing or parallel to its forward and not shown rearward edges 137, and a lever 139 pivoted at one end 141 to the forward edge 137 and, between the lever ends at 143, to the bracket plate 135 with a similar pivoting arrangement (without the lever) at the rear edge of wall panel 123. In this manner, the lever arrangement can move the wall panel 123 simultaneously vertically and laterally toward and away from the sidewall 111, provided it is of course properly guided at the remaining two lower corners. This is obtained by providing, at each remaining corner, a guiding structure such as shown in FIGS. 12 to 14. Each structure consists of a bracket plate 145 formed with a guiding slot 147 and projecting from the cabinet sidewall 111 to face the corresponding vertical edge (forward edge 137 or the not shown rearward edge) of the panel 123. Two (2) guide pins 149 project from the corresponding vertical edge 137 and the not shown rearward edge and engage into the slots 147. The latter is inclined downwardly from the sidewall 111. In this manner, the two pins, and therefore the wall panel 123, are displaced simultaneously vertically and laterally when the lever 139 is pivoted, as can be understood from FIGS. 12 to 14. Each slot 147 preferably includes a short vertical branch, at its lower end, into which the corresponding pins 149 may drop when the wall panel 137 rests firmly against the adjacent side panel of the trash container, as in FIG. 12. These short vertical branches will prevent the compaction pressure from forcing the pins 149 up the inclined branches 147 and move the resisting wall panel 123, as in FIGS. 13 and 14. For the same purpose, the service door 21 (FIG. 1) should be provided with a stop block 151 facing the free end of the lever 139 when the door 21 is closed, which is the situation shown in FIG. 12.

Figure 15:
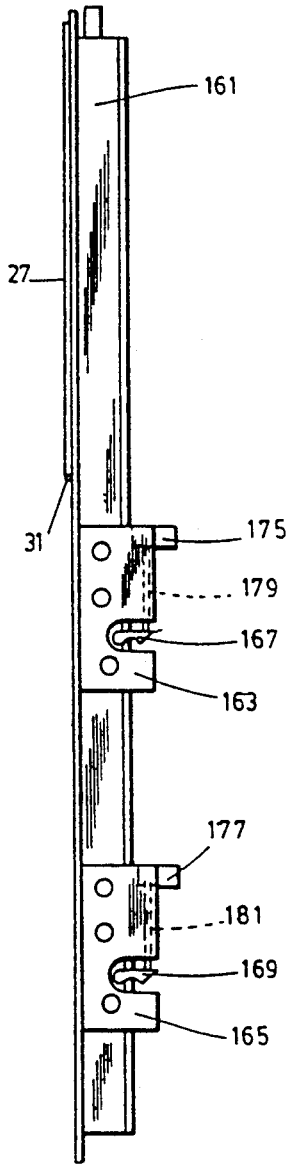
FIG. 15 is a diagrammatic elevational view of the lock riser of the service door.
Figure 16:
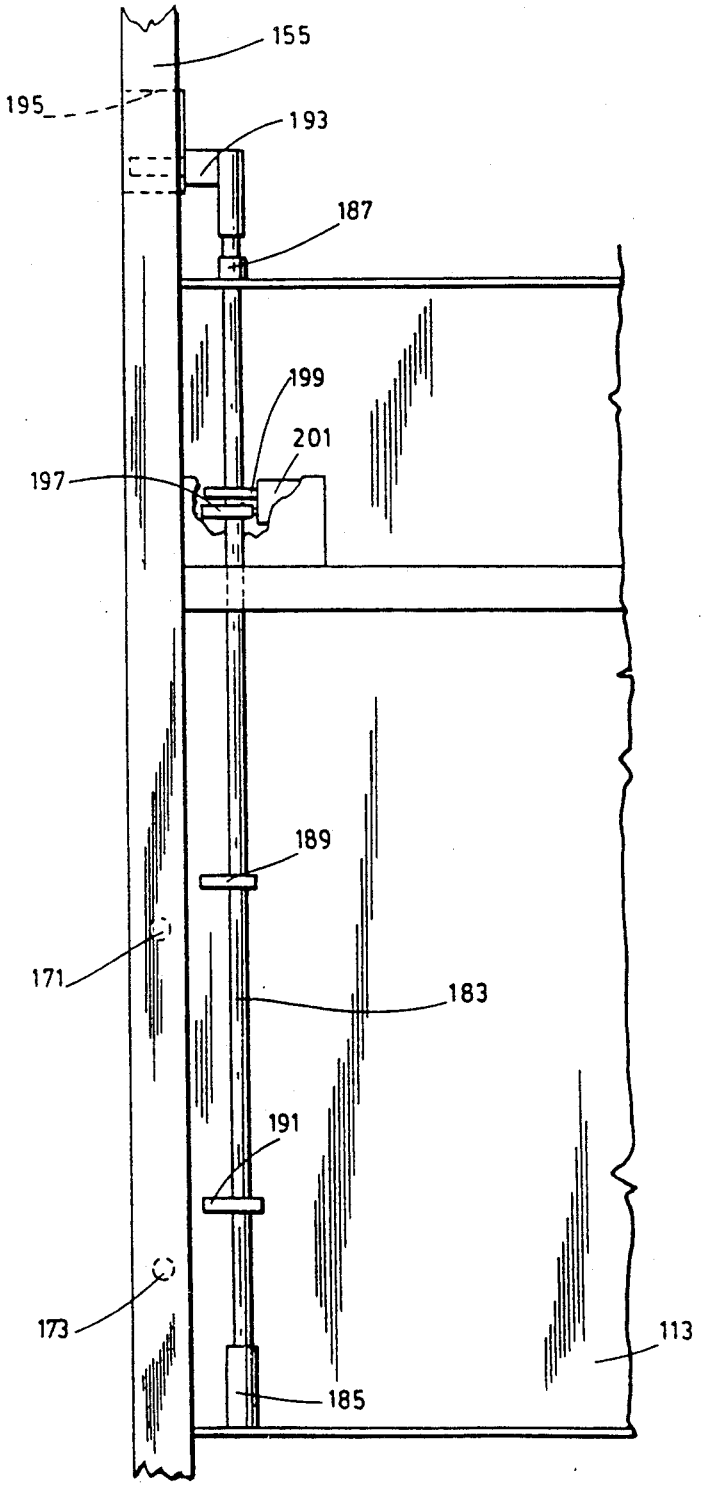
FIG. 16 is a diagrammatic elevation view of part of the side wall of the compactor chamber, on the door lock side, with the covering plate removed to show the inner structure.

Referring now to FIGS. 1 and 15 to 18, the front wall opening 19 (FIG. 1) is defined, on opposite vertical sides, by a hinge jamb 153 (FIGS. 1 and 17) and by a lock jamb 155 (FIGS. 1 and 16). The service door 21 is mounted on the hinge jamb 153 by means of any conventional hinge structure such as the previously mentioned hinge structure 23. The door 21 has an inner frame 159 which includes a lock riser 161 facing the lock jamb 155 when the door is in closed position. A locking assembly is provided on the lock jamb 155 and on the lock riser 161 for locking the service door 21 when the latter is in closed position. This locking assembly, which may be of the type used in automobiles for locking a door to the frame, is symbolically shown in FIGS. 15 and 16 to comprise a pair of vertically spaced lock parts 163, 165, fixed to the lock riser 161 and having latches 167, 169, which become interlocked with cooperating lock parts, in the form of lock bolts 171, 173, on the lock jamb 155 belonging either to the front wall 17 or to the rightward sidewall 113 (FIGS. 10, 11) of the compaction chamber 7. The latches 167, 169, are pivoted at one end and are downwardly biassed by not shown springs. As illustrated in FIG. 15, each latch is formed along its lower edge with a rounded recess following an inclined ramp. When the door 21 is closed, the bolts 171 and 173 ride on the inclined ramps, pivot the latches 167, 169, and fall into the rounded recesses that follow, to be held therein by the springs. Release of the door lock is obtained by lifting the latches 167, 169, against their spring biasses to free the lock bolts 171, 173. This is achieved, according to the invention, by operating keys 175, 177, movably mounted for vertical displacement on the lock parts 163, 165, and connected to the latches 167, 169, in any convenient manner, such as by links 179, 181, to cause disengagement of the latches 167, 169, from the lock bolts 171, 173. Thus, by lifting the keys 175, 177, the latches 167, 169, are pivoted counterclockwise against their spring bias and free the lock bolts 171, 173, thereby allowing the service door 21 to be opened. Lifting of the keys 175, 177, is obtained by an elongated operating bar 183 mounted, on the sidewall 113 of the compaction chamber 7, for vertical displacement by having its ends slide in suitable bearings 185, 187, of the sidewall inner structure. The bar 183 has a pair of levers 189, 191, suitably positioned to engage the lower faces of the liftable keys 175, 177, when the door 21 is closed. Lifting of the bar 183, and thus of the keys 175, 177, to release the lock bolts 171, 173, from the latches 167, 169, whereby to allow opening of the service door 21, is obtained by lifting a handle 193, radially projecting from the upper end of the bar 183 and riding in a slot 195, located in recess in the front panel 17 so as to be available from the outside of the door 21 (see FIG. 1).

It will be appreciated, of course, that while two sets of locking parts 163, 171 and 165, 173, have been shown and described, one such set may be found sufficient depending on the size of the service door 21.

Another important improvement brought about by the present invention is in the provision of an electronically controlled locking mechanism, capable of locking the bar 183 and thus preventing it from being lifted and thereby the service door 21 from being opened, as long as the trash container 115 is not full of compacted trash. Detection of the fullness of the container 115 can easily be achieved by sensing the lowermost position of the compaction head at each compaction cycle.

In the embodiment of FIGS. 15 and 16, this bar locking mechanism is made up of an additional lever 197 on the bar 183 and of a locking pin 199 capable of being slid over lever 197, when actuated by a solenoid 201, whenever trash may still be compacted, as determined by the electronic controls. The locking pin 199 and solenoid 201 are mounted on the framework of the compactor sidewall 113 and connected to the electronic compaction control circuit of the motor 47, in standard manner.

Figure 17:
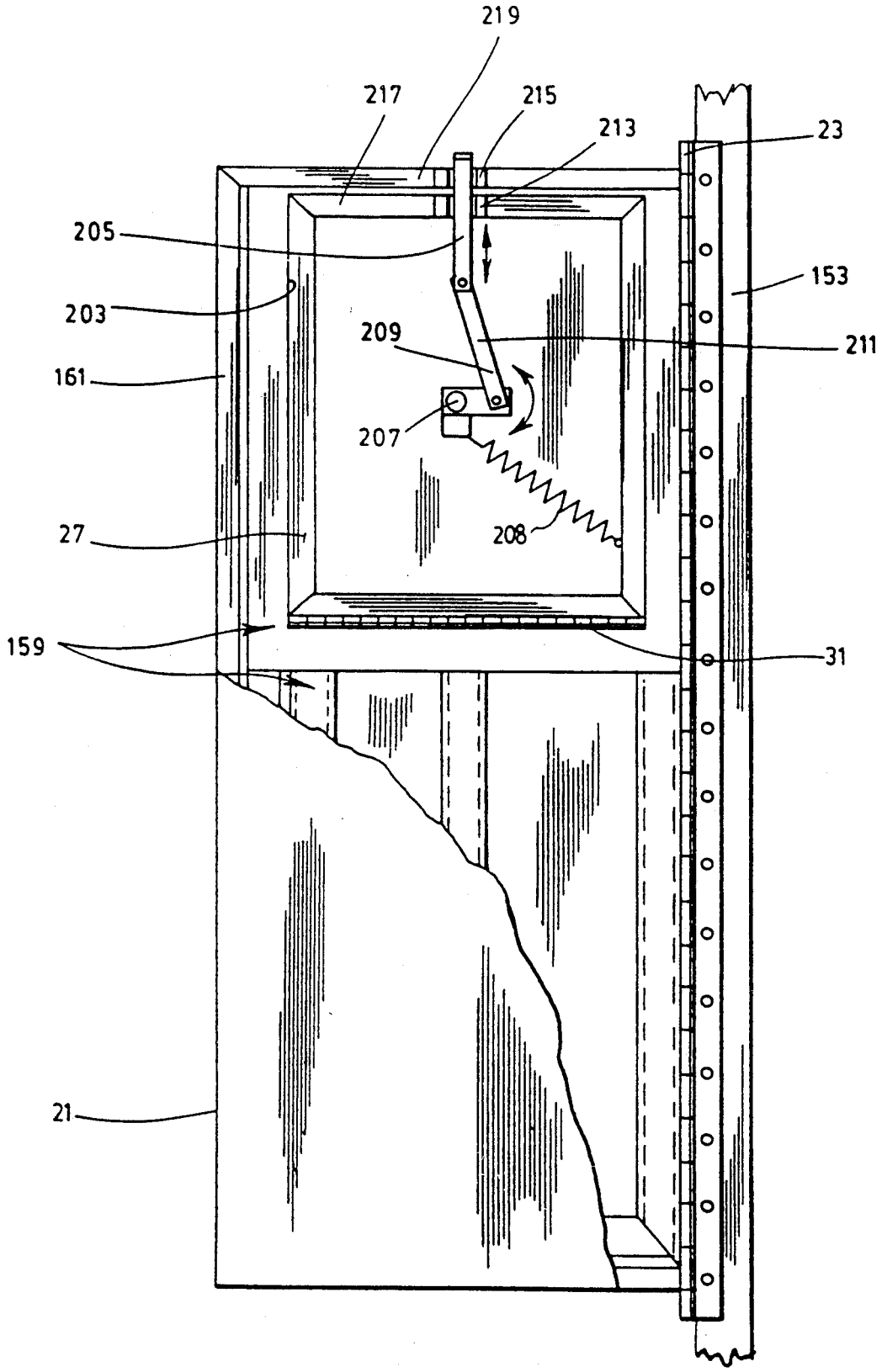
FIG. 17 is a diagrammatic elevational view of the service door, seen from the inside with the inner covering plate partly torn away to show the inner structure.
Figure 18:
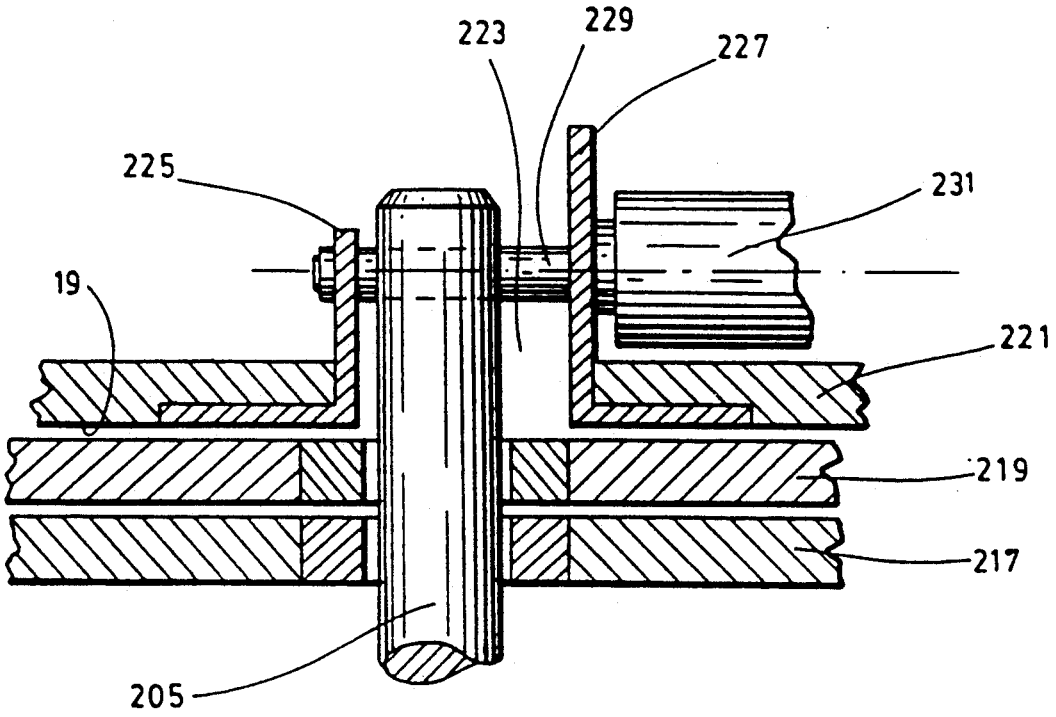
FIG. 18 is a diagrammatic cross-sectional view through the trash door locking mechanism.

Referring now to FIGS. 17 and 18, it is seen that the service door inner frame 159 defines a rectangular opening 203 for the door 27, the door serving to introduce trash in the trash container 115 standing on the L-shaped support 99 in the compaction chamber 7. The door 27 can be opened by the pivotable handle 29 (FIG. 1) capable of moving a lock bolt 205 in a rectilinear reciprocating motion through a linkage assembly consisting of a pivot pin 207 to which the handle 29 is fixed on the outside, of a radial link 209 also fixed to the pin 207 and of a further link 211 of which the ends are pivoted to the free end of the link 209 and to the lower end of the bolt 205. The lock bolt 205 is held in the upward position by a spring arrangement 208, which creates a vertical pressure transmitted through the linkage assembly 207, 209 and 211. The bolt 205 is able to slide freely through bores of successive bearings 213, 215, across lintels 217, 219, of the trash door 27 and service door 21 into a space 223 above lintel 221, which forms an integral part with the structural frame around door opening 19 FIG. 18). The bolt 205 has a length sufficient to extend beyond the lintel 221 between a pair of angle brackets 225, 227, fixed to it and bordering the space 223. A second locking mechanism, similar in functioning to mechanism 199, 201 of FIG. 16, is provided in the front wall 17 attached to lintel 221 and electronically controlled so that when the compactor motor 47 is energized, the locking mechanism prevents the lock bolt 205 from being withdrawn from the space 223 and through the bores of the bearings 213, 215, thereby preventing opening of both the service door 21 and the trash door 27 during compaction. The locking mechanism shown comprises a locking pin 229 operated by a solenoid 231, the locking pin being slidable through appropriate coaxial holes of the brackets 225, 227, and through a transverse hole of the lock bolt 205, as clearly shown in FIG. 18.

What is claimed is:

1. A trash compactor comprising:

a cabinet defining a front compaction chamber and a rear storage chamber behind and in communication with said compaction chamber, said compaction chamber having opposed sidewalls, a front wall defining a door opening, and a bottom wall;

an L-shaped support for supporting a container insertable in said compaction chamber and into which trash is to be compacted, said support being movable between said front and rear storage chamber and having a horizontal bottom member and an upright rear member suitable for receiving one such trash container;

releasable holding means, provided on said bottom member of said support and on said bottom wall of said compaction chamber, for holding said support in said compaction chamber during compaction, and for allowing release of said support for displacement thereof into said storage chamber after compaction, said releasable holding means comprising at least one groove formed in one of said bottom wall and said bottom member and at least one projecting element provided on the other one of said bottom wall and said bottom member, said groove and said projecting element having a corresponding wedge shape in a plane extending perpendicular to said support rear wall and being positioned and sized for snugly fitting into each other, a compaction pressure-resisting wall panel movably mounted inside said front compaction chamber adjacent and parallel to one of said opposed sidewalls of said front compaction chamber, said wall panel having opposed forward and rearward vertical edges, a lower horizontal edge, and four corners;

lever means, provided on said sidewall and on said forward vertical edge at an upper one of said four corners, for moving said wall panel simultaneously vertically and laterally toward and away from said one sidewall; and guide means, provided on said one sidewall and on said opposed edges of said wall panel, for ensuring movement of said wall panel in parallel relationship with said one sidewall, e.g., wherein the bottom member of said L-shaped support has a first lateral extension spaced between the lower edge of said wall panel and said bottom member which becomes lodges beneath the lower edge of said wall panel when said wall panel is moved away from said one sidewall; and wherein said wall panel moves between a position in contact with said one sidewall to a position which prevents release of said holding means when said wall panel is positioned away from said one sidewall.

2. A trash compactor as claimed in claim 1 wherein said groove is formed on said bottom member and said projecting element is provided on said bottom wall.

3. A trash compactor as claimed in claim 2 wherein said wedge shape forms a right angle triangle with one side of the right angle facing away from said support rear wall.

4. A trash compactor as claimed in claim 3, further comprising a gripping element along one edge of said support member at the end thereof away from said rear member.

5. A trash compactor as claimed in claim 1, wherein said guide means comprise:

bracket plates formed with guiding slots; said plates projecting from said one sidewall and facing said opposed vertical edges at lower corners of said wall plate;

guiding pins projecting from said opposed vertical edges of said wall plate, said pins engaging into said slots to be guided thereby, and wherein aid guiding slots are inclined downwardly from said one sidewall to allow said pins, and thereby said wall panel, to be displaced simultaneously vertically and laterally when said lever means are actuated.

6. A trash compactor as claimed in claim 5, wherein the other one of said opposed sidewalls is formed, along the lower edge thereof adjacent said compaction chamber bottom wall, with a rabbet suitable to receive a second lateral extension of said support, opposite said first extension, said rabbet having a height sufficient to allow disengagement of said releasable holding means when said wall panel stands close to said one sidewall.

7. A trash compactor as claimed in claim 6, further comprising a gripping element along one edge of said support member at the end thereof away from said rear member.

8. A trash compactor as claimed in claim 1, wherein said lever means comprise:

a lever bracket plate projecting from said one sidewall and facing said forward vertical edge, and a lever pivoted at one end to said forward vertical edge and, between the ends thereof, pivoted to said bracket plate.

9. A trash compactor as claimed in claim 1, wherein said front wall door opening is defined, on opposite vertical sides, by a hinge jamb and a lock jamb, and said cabinet further comprises:

a service door hingedly mounted on said hinge jamb and having an inner frame including a lock riser facing said lock jamb when said service door is in closed position;

fastening means on said lock jamb and on said lock riser for locking and unlocking said service door when in closed position, said fastening means comprising:

an elongated operating bar and means, on an adjacent one of said compaction chamber walls, mounting said bar for vertical displacement thereof parallel to said lock jamb;

lock parts, on said lock jamb and on said lock riser, engageable with one another to lock said door when closed;

a downwardly biassed key on said lock riser operable, when lifted, to free said fastening means, and unlock said door;

a lever, on said bar, positioned thereon to engage the lower face of said liftable key, when said door is closed; and a handle on said bar projecting radially therefrom so as to be gripped from outside said cabinet, whereby lifting of said handle when said door is locked, causes said lever to lift said key and release said lock parts.

10. A trash compactor as claimed in claim 9, wherein said cabinet further defines a remote chamber above said compaction chamber and additionally comprises:

a compacting mechanism in said remote chamber, said mechanism having an actuating motor, and a first electronically controlled locking mechanism located in said compaction chamber wall, said locking mechanism being capable of locking said bar and thus preventing said bar from being lifted and thereby said door from being opened as long as the trash container is not full of compacted trash.

11. A trash compactor as claimed in claim 10, wherein said first locking mechanism comprises:

an additional lever on said bar, and a solenoid-operated locking pin, slidable over said additional lever to prevent said bar from being lifted.

12. A trash compactor as claimed in claim 10, wherein said service door inner frame defines a trash opening for introducing trash into said compaction chamber and said compactor further comprises:

a trash door for closing said trash opening; said trash door having an inner frame;

lintel members standing side-by-side when said service door and said trash door are closed, said lintel members being provided, respectively, along said service door opening and on said inner frames of said service door and trash door; said lintel members being formed with lock bolt through bores, becoming coaxial when said doors are closed;

a handle mechanism mounted on said trash door inner frame, said handle mechanism including a lock bolt capable of sliding through said bores when said handle mechanism is operated, said bolt having a length sufficient to extend beyond said lintel member provided along said service door opening, and a second electronically controlled locking mechanism in said compaction chamber wall, said second locking mechanism being capable of locking said bolt and thus preventing said bolt to move out of said coaxial lock bolt through bores when trash is being compacted.

13. A trash compactor as claimed in claim 12, wherein said lock bolt has a transverse hole at the free end thereof and said second locking mechanism comprises:

a solenoid-operated locking pin slidable in said transverse hole when said motor is actuated.

* * * * *